United States Patent [19]

Schön et al.

[11] 4,356,085

[45] Oct. 26, 1982

[54] ROTARY SCREENING MACHINE FOR PULP SUSPENSIONS

[75] Inventors: Werner Schön; Albrecht Meinecke, both of Heidenheim, Fed. Rep. of Germany

[73] Assignee: J. M. Voith GmbH, Fed. Rep. of Germany

[21] Appl. No.: 236,626

[22] Filed: Feb. 20, 1981

[30] Foreign Application Priority Data

Feb. 21, 1980 [DE] Fed. Rep. of Germany ..... 3006482

[51] Int. Cl.[3] ..... D21D 5/02; B07B 1/20

[52] U.S. Cl. ..... 209/273; 209/306

[58] Field of Search ..... 209/273, 305, 306, 379, 209/270, 250, 283, 300; 210/414, 415

[56] References Cited

U.S. PATENT DOCUMENTS

| | | | |
|---|---|---|---|
| 1,533,410 | 4/1925 | Haug | 209/270 |
| 1,670,473 | 5/1928 | Milne | 209/270 |
| 1,722,874 | 7/1929 | Wells | 209/273 |
| 1,921,750 | 8/1933 | Heinrich et al. | 209/300 X |
| 2,337,113 | 12/1943 | Knight | 209/273 |
| 2,738,065 | 3/1956 | Mahlkuch | 209/306 X |
| 3,149,065 | 9/1964 | Van Doorn | 209/283 X |
| 3,235,087 | 2/1966 | Andrews | 210/415 |
| 3,247,965 | 4/1966 | Braun | 209/270 X |
| 3,303,759 | 1/1968 | Clarke-Pounder | 209/273 |
| 3,404,065 | 10/1968 | Ingemhasson | 209/270 X |
| 3,458,038 | 7/1969 | Young | 209/273 X |
| 3,898,157 | 8/1975 | Hooper | 209/273 X |
| 3,964,996 | 6/1970 | Holz | 209/273 X |
| 4,200,537 | 4/1980 | Lamort | 209/273 X |
| 4,202,761 | 5/1980 | Holz | 209/17 |

FOREIGN PATENT DOCUMENTS 130871 10/1978 Fed. Rep. of Germany ..... 209/300

*Primary Examiner*—Ralph J. Hill

*Attorney, Agent, or Firm*—Ostrolenk, Faber, Gerb & Soffen

[57] ABSTRACT

The disclosure concerns a rotary screening machine for moving pulp suspension through a screening slot and for separating impurities from the pulp suspension. An annular rotatable drum is surrounded by an annular porous screen basket that is spaced away to define a screening slot. Pulp suspension is delivered to one axial end of the slot and is discharged from the other axial end of the slot. Generally wedged shaped vanes, widening in the axial direction between the leading and trailing ends of the vane, are provided around the drum. The wedge defining surfaces may also be inclined with respect to a respective plane perpendicular to the axis. The space between the wedge surfaces is an open volume. A wall in that space is oriented to help create appropriate vacuum and eddy conditions behind the vane. The drum may have different zones, with the lower zone being provided with vanes and the upper zone being generally smooth. Other types of vanes or projections may be provided in the intermediate zone. Water sprayed into the slot dilutes the suspension. The configuration of the vane causes conveyance of the pulp suspension generally toward the impurities outlet and conveys the impurities to that outlet. The configuration of the vanes also causes the suspension to pulsate across the screen basket which dislodges pulp suspension fibers that otherwise might become matted on the screen.

62 Claims, 11 Drawing Figures

Fig. 2
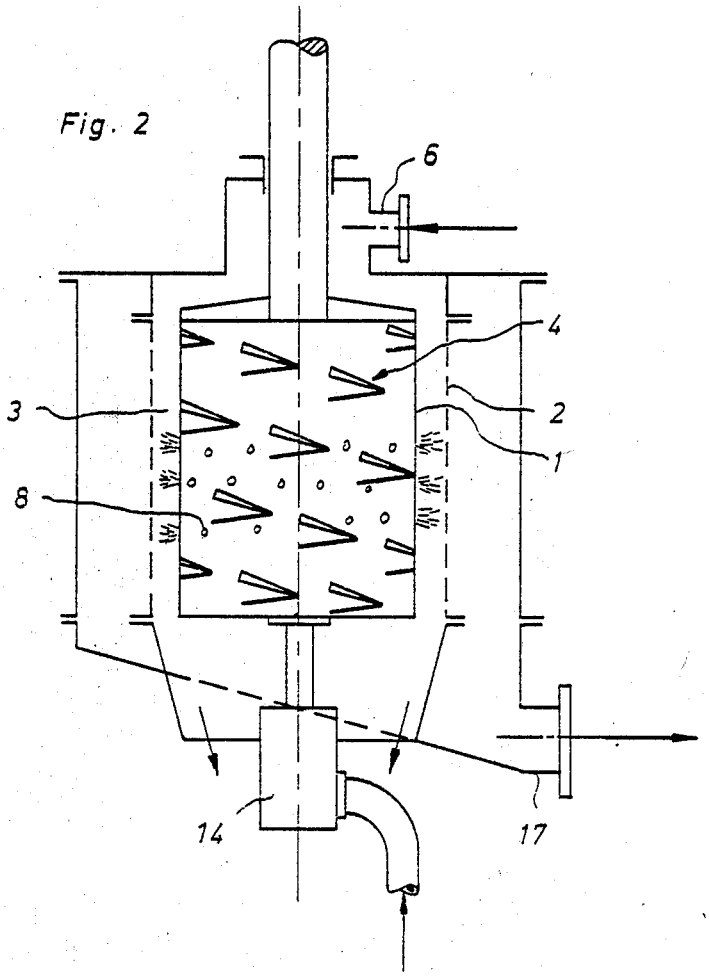
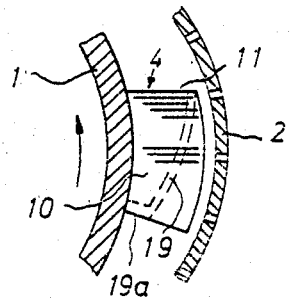
Fig. 4
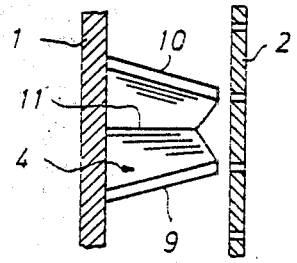
Fig. 1a

ROTARY SCREENING MACHINE FOR PULP SUSPENSIONS

BACKGROUND OF THE INVENTION

The present invention relates to a rotary screening machine for pulp suspension that is contaminated with impurities. In particular, the invention relates to means in the machine, and particularly the sorting and conveying vanes, for causing the suspension and particles therein to pulsatingly move across the screen, preventing particle build-up on the screen.

A rotary screening machine of the type with which the invention is employed comprises a rotating drum, an annular basket like screen around the drum, an annular screen slot or space defined between the drum and the screen and sorting means in the screen slot, e.g. supported on the drum, for moving the suspension axially along the screen slot and for also sorting out the desirable particles and the rejected impurities, so that the former and latter materials may pass to respective collection areas.

One such rotary screening machine is known from West German Provisional Patent (Auslegeschrift) No. 27 12 715. In that machine, projections are provided on the rotating drum, and the projections rotate at a slight distance from a perforated screen basket. A vacuum is produced on the edges of the projections which are located toward the rear in the direction of flow (the trailing or run-off edges). This helps pieces of fiber and similarly shaped components of the suspension being screened to pass through the holes of the screen to be thereafter fed to one pulp outlet. The vacuum produced at the trailing edge of a projection is not very great. Furthermore, in this screening machine, the drum and the projections arranged thereon contribute minimally to conveying the suspension axially through the machine, i.e. axially of the rotating drum. Thus, a pump, or the like, must be provided to separately produce pressure for moving the pulp suspension.

SUMMARY OF THE INVENTION

The object of the present invention is to obtain good separation of the components of a fiber suspension in a screening machine with the use of as little power as possible.

Another object of the invention is to cause pulsation of the suspension and its components radially across the screen, for reducing screen clogging.

A further object is to improve axial conveyance of the suspension.

The objects are realized according to the invention. The projections on the drum are sorting vanes projecting radially outwardly from the drum. Starting at what is the leading edge of each vane during rotation, the top and bottom surfaces of the vane taper wider in the direction of the axis of the drum in a generally wedge shape.

This development of the sorting vanes alternately produces pressure and relatively large vacuum at the screening slot. As the vanes rotate past the screen basket, with the pulp suspension containing impurities in the screen slot, wherein the fibers in suspension and the impurities in suspension possibly adhere to the screen, the vanes cause the fibers and impurities to be constantly detached from the screen basket. This detachment effect may be reinforced by the eddy produced at the trailing ends of the vanes. In this way, the parts which are to be sorted out, namely the fibers in the fiber suspension, are given an increased opportunity to reach and to pass out through holes in the screen basket, and in this way to be removed from the suspension.

The vane profile is of wedge shape and thus has only a low coefficient of resistance so that the acceleration of the suspension by the vanes, particularly in the circumferential direction, is rather small. As a result, the screening machine operates with relatively low consumption of power. Spinning of the components of the suspension of the vanes can also easily be avoided in that the leading edge of the vanes (as seen in the direction of rotation) are slightly beveled rearwardly.

The screening machine is of simple construction and is easy to manufacture. By simply turning of the vanes on a lathe, the screen slot which is to be maintained between the radially outer edge of the vanes and the screen basket can be produced relatively simply.

The development and arrangement of the sorting vanes in accordance with the invention is also favorable in that it substantially eliminates the detrimental effects that might be caused by pulsations through the use of a relatively large number of vanes, since the pulsations are then of only slight amplitude.

In a preferred further development of the invention, at least one of the wedge surfaces that defines the sorting vane is inclined from the horizontal, i.e. from a plane perpendicular to the axis of the drum, along the radial direction of extension of the vane to produce additional conveyance momentum components of the fiber suspension with respect to the screen basket.

The wedge surfaces that define each vane may cooperate to give the vane a generally "V" shaped profile, widening from the leading to the trailing ends of the vane. An open space is defined between the wedge surfaces of a vane and a vacuum develops there as the drum rotates. An additional lateral wall may be positioned in that open space, extending between the upper and lower wedge surfaces and also extending rearwardly from the leading edge of the vane, to control the size and shape of that space between the wedge surfaces that faces radially outwardly toward the screen basket. The orientation and position of this wall will cooperate in determining the direction of pulsation of the fiber suspension as each vane rotates past. In a preferred embodiment, that wall is shaped, oriented and positioned so that both the radial and axial length of the space between the wedge surfaces gradually increases from the leading edge of the vane to the trailing edge thereof. Various other orientations of the limiting wall are possible, including an orientation where it is radially closer to the screen basket near the leading edge than at the trailing edge of the vane, or vice versa. The wall orientation selected depends upon the particular pressure-vacuum condition that is sought to be established there.

Along the length of the sorting drum, and preferably generally at is axially central region, the drum has diluting liquid spray holes, i.e. water spray holes, defined in it. Opposed to the spray holes, the generally porous screen basket has no openings through it, thereby confining the sprayed diluting water within the screen slot.

The drum may have different axial zones, with the sorting vanes being nearer the lower zone and the upper zone not having vanes of the type described above. By appropriate arrangement of the vanes, preferably as described just above, the accepted fiber material is conveyed toward one axial end of the machine while the rejected impurities are conveyed to the other end. The sorting vanes are configured to axially move the suspension in a manner calculated to cause the above described separation.

Other objects and features of the invention will now be described with reference to a few illustrative embodiments of the invention which are shown in the drawings.

BRIEF DESCRIPTION OF THE DRAWINGS

FIG. 1*a* is a partial axial sectional view through the sorting drum like that of FIG. 1, shown on a large scale;

FIGS. 2 and 3 are the same type of view as FIG. 1 respectively showing further embodiments of screening machines;

FIG. 4 is a partial radial sectional view through one modified embodiment of a sorting drum, on a larger scale;

FIGS. *7a* to *7c* are views corresponding respectively to FIGS. 4–6 showing still another embodiment of a sorting drum.

DESCRIPTION OF THE PREFERRED EMBODIMENTS

Figure 1:
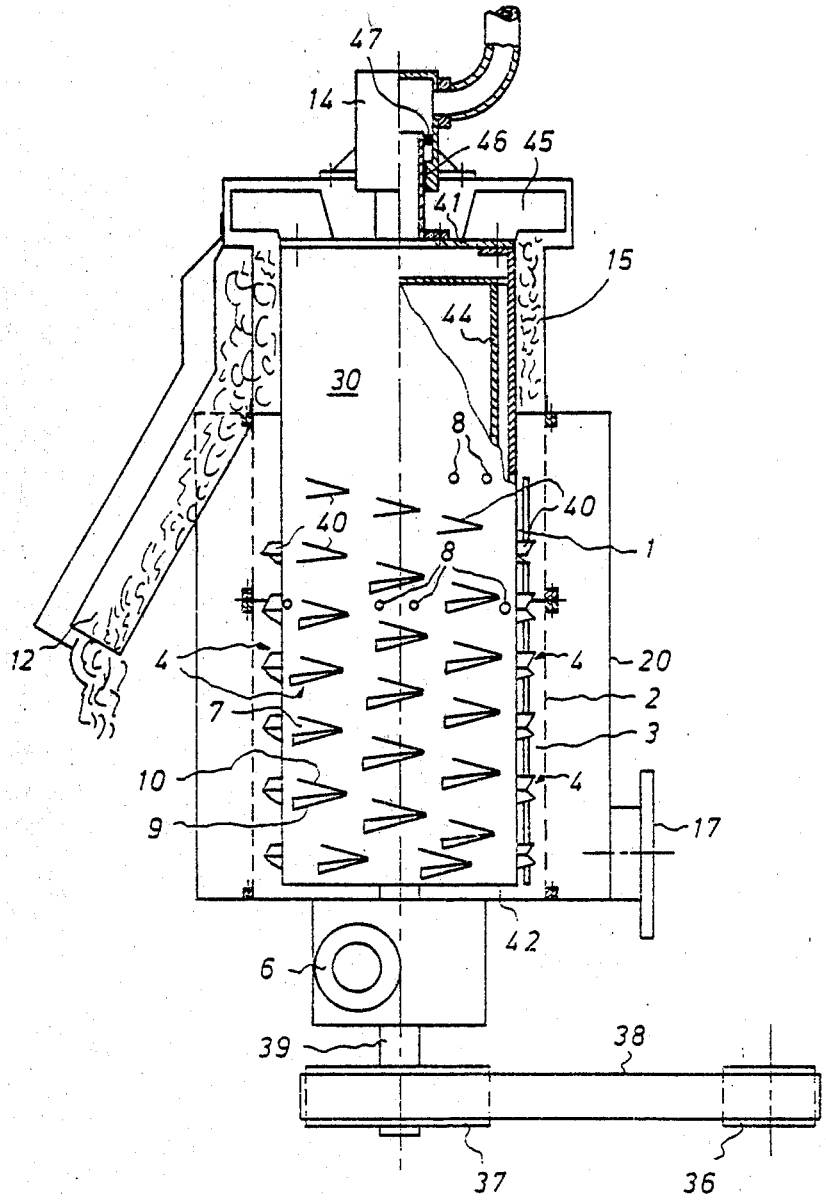
FIG. 1 is an axial sectional view showing a first embodiment of a rotary screening machine in accordance with the invention, which is of open, unpressurized construction.

Referring to FIG. 1, a rotary screening machine according to the invention includes an outer housing 20. An annular, cylindrical drum 1 is rotatably supported in the housing 20 and rotates about is axis with a constant radius annular screen slot 3 within an annular screen basket 2. The constant radius of the slot 3 is defined between the periphery of the drum 1 and the screen basket 2. The drum has end walls 41 and 42 at its respective axial ends. The shaft 39 supports the drum 1 for rotation. The shaft 39 is supported horizontally in the lower part of the housing 20 in a bearing (not shown). The shaft 39 is driven to rotate by the belt 38, via drive pulleys 36 and 37. The pulley 36 may be fastened to the shaft, for instance, of an electric motor (not shown).

Fiber suspension to be sorted is fed from below, through the feed connection 6, directly into the screen slot 3 between the drum 1 and the screen basket 2. The suspension is picked up in the slot 3 by the rotating vanes 4 which are fastened to the shell of the rotatable drum 1. The suspension is conveyed along the screen slot 3 in the axial direction to the rejects outlet 12 located at the upper end of the drum. The properly divided, cleaned pulp passes through the holes or pores along the length of the screen basket 2, and the pulp piles up in the housing 20 to a certain height and then discharges radially through an accepted pulp outlet 17. The rejected material passes tangentially out of the sorter at the upper end of the screen slot 3, through a chute 12.

The rotor, or drum 1, carries sorting vanes 4 and 40 projecting from its surface. Vanes 40 are described below. Each sorting vane 4 on the drum 1 is generally of wedge shape, tapering gradually wider, measured axially of the drum, rearwardly from the narrow leading edge 11 of the vane. Each vane 4 has an upper, upwardly inclined, wedge surface 10 and a lower, downwardly inclined, wedge surface 9. The direction of the inclines just mentioned is rearwardly with respect to the direction of rotation of the drum. Each vane 4 is defined by thin plates defining wedge surfaces 9 and 10, which thereby defines an open volume between the wedge surfaces 9 and 10. Upon rotation of the drum, a vacuum can build up between the surfaces 9 and 10, starting from the leading end 11 of each vane and increasing to the trailing or run-off end. At the trailing end of the vane, practically at its burble edge, eddies are produced which, upon the passage of the vanes along the inside of the screen basket 2, cooperate with the vacuum produced by the vanes to detach the mat of suspension fibers, which have deposited on the screen basket. This prevents the openings in the basket from becoming clogged. Also, constant remixing of the suspension is obtained.

Both the sorting vanes 4 and the vanes 40 are arranged somewhat in a helical array around the drum 1. But, the sorting vanes 4 are helically arranged to an extent that they do not cause an excessive axial conveyance component of the fiber suspension along the screen slot 3 to the rejects outlet 12. In practice, the vanes 4 are staggered somewhat with respect to each other, so that their lower wedge surfaces 9 also strike a part of the suspension upon the rotation of the drum 1.

In this embodiment, the lower wedge surfaces 9 of the vanes are inclined downwardly with increasing distance rearwardly from the leading edges 11 of the vanes. At the same time, in the embodiment of FIG. 1*a*, the lower wedge surfaces incline upwardly from the horizontal (or from a plane perpendicular to the axis of the drum 1), moving radially outwardly of the drum 1. This inclination of the surfaces 9 of the vanes causes a component of motion of the particles impinging upon the vanes which is directed toward the screen 2. In this way, the particles that were initially drawn away from the screen 2 by the vacuum produced by the rotating vanes are again conveyed against the screen, which increases the possibility that particles of acceptable quality pulp can be sorted through the holes in the screen 2. Of course, the upper wedge surfaces 10 of the vanes 4 may also be developed in the same manner as shown in FIG. 1*a*. These surfaces 10 are inclined upwardly from the leading edges 11 of the vanes but downwardly with respect to the horizontal, moving radially outwardly of the drum 1.

In this way, the two essential features of the sorting process in this screen slot, namely the detachment of the fibers of the suspension from the screen 2, which is caused by the vacuum and eddying, and the conveying of the fibers to the screen, continuously alternate, i.e. a pulsating movement of the fiber suspension is produced in the screen slot 3, and specifically in its lower zone where the sorting vanes 4 are present on the drum 1.

A ring of impurities 15 that forms in the uppermost zone of the screen slot 3 should consist predominantly of rejects or impurities.

A different development of the lower wedge surfaces 9 of the sorting vanes 4 over at least a selected region of the surface of the rotary drum prevents rapid passage of the suspension, particularly of suspension enriched with rejects, directly along the surface of the rotor drum, and also prevents stagnation of the flow and possibly a clogging, with the poorer sorting effect inherent therein, from occurring directly on the screen basket.

On the shell of the rotor drum 1, there are three different regions. The lowermost region is provided with above described sorting vanes 4. Adjoining the lower region is a more central axial region of the rotor drum on which other sorting vanes 40 are present. In contrast to the sorting vanes 4 present in the lower region of the drum, the vanes 40 may either be so inclined on their lower wedge surfaces 9 that their suspension conveying action away from the rejects outlet 12 is less than in the case of the other vanes 4, or the lower wedge surfaces 9 of these vanes 40 are to be narrower in the radial direction starting from the surface of the drum, as can be noted from FIG. 1, than the upper wedge surfaces 10 of either of the sorting vanes 4 or 40. In this way, a stronger deceleration of the pulp upon the passage thereof to the rejects outlet 12 is produced directly on the drum surface than on the screen surface. As a result, no build-up can develop on the screen basket 2, due to the better conveying action, or on the other hand, a better conveying action in the direction toward the rejects outlet 12 is obtained.

Furthermore, the sorting vanes 40 are also developed differently from the other vanes 4, in that their lower wedge surfaces 9 are not inclined from the horizontal measured along the radial direction, in the same way as their upper surfaces 10 are inclined.

The upper, third region 30 of the rotor drum is smooth, i.e it is developed substantially without sorting vanes 4 or 40, and it lies predominantly above the screening zone, or screen slot 3. This is necessary to permit concentrating of the rejects 15. This produces reject consistencies of 20 to 25% and more, by volume of solid to liquid materials, at the rejects outlet. For better removal of rejects, the rotor drum 1 is provided with reaming vanes 45 at its upper end.

Spray holes 8 for pulp diluent, i.e. water, are arranged in the vicinity of the smooth region 30 of the drum and are located below the top edges of the uppermost sorting blades 40. In this way, too great dilution of the rejects is avoided and rubbing of the rejects is also increased. The other spray holes for dilution water 8 lie in an axially central region along the rotor drum 1, opposite a nonporous section of the screen basket 2 where there are no sorting holes or slots. With relatively little spray water, the screen 2 is kept suitably free of fibers by dilution of the suspension. It is also preferred to provide the region of the screen basket 2 lying below the spray holes 8 with relatively large screen perforations of, for instance, 6 mm diameter as compared with screen perforations in the upper region of about 4 mm diameter.

Spray water is fed via the connection head 14 into the hollow space 44 of the double jacket, which extends at least partially down along the rotor drum. A support 46 for the drum and a seal 47 are also provided there.

The inclination, with respect to the horizontal planes through the respective leading edges 11 of the sorting vane 40, of the upper wedge surfaces 10 of those sorting vanes 40 adjacent the smooth region 30 of the rotor drum is about 10° and the inclination of the lower wedge surfaces 9 from the same planes is only about 5°, or even less inclination, if the vanes 40 are not made narrower in the radial direction. Where the selected alternative is a difference in radial width between the upper and lower wedge surfaces of the sorting vanes 40, this is selected to be a maximum of about half the width of the screen slot 3. The difference can amount, for instance, to about 20 mm when the screen slot is about 50 mm wide.

The lower region of the drum 1, which has normal sorting vanes 4, occupies about one-half the height of the screen basket 2, and the upper, smooth region of the drum also occupies about one-third of that height. The latter could, however, also be made shorter for instance, down to one-quarter of the height of the screen.

It is also advisable to prevent too strong rotation of the suspension in the screen slot 3. Weir strips (not shown), which extend parallel to the axis of rotation of the drum, are formed on the inside of the screen basket. Only about four of the strips are necessary for this purpose. This produces a better separating effect.

Figure 8:
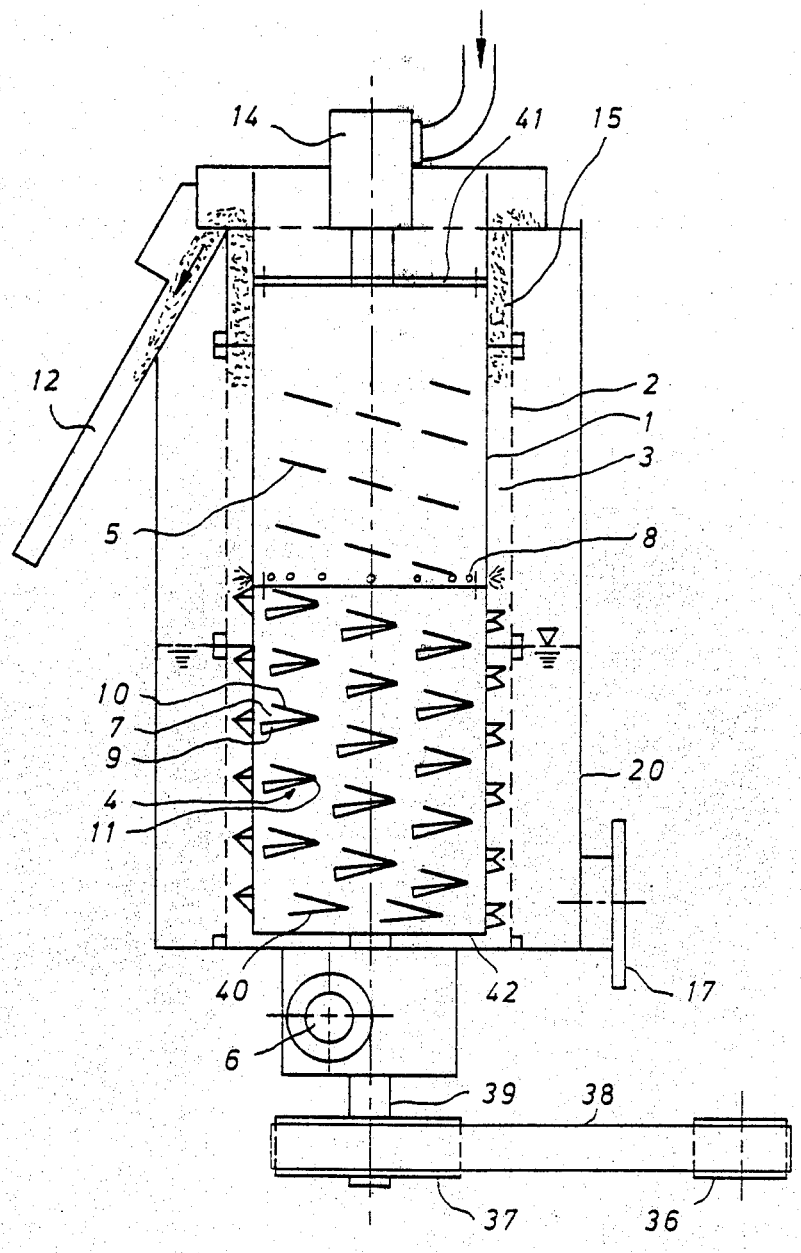
FIG. 8 shows a screening machine according to the invention with a different embodiment of a drum.

FIG. 8 shows a screening machine construction having a different division of zones. The drum and screen slot 3 are developed with three zones in this embodiment. In the lowermost zone, the drum 1 carries the sorting vanes 4. In the adjoining zone above, the drum carries vanes 5, which serve predominantly for the transport of the rejects toward the upper, outlet end of the sorter. In the top zone 30, the rotor 1 is smooth, being without projections, vanes or the like. In this zone, the rejects residue is to be held back, so that too rapid a passage thereof through the rotor, with too low a separating effect of the acceptable quality pulp, is avoided.

A spray-water feed with a spray-water connection head 14 is provided in the inside of the drum 1 for diluting the suspension, again by means of spray water flowing through the spray openings 8. The openings are arranged predominatly in the axially central part of the rotor. But, these openings may extend into the second, central zone and even to the third upper zone, in order to still make it possible to separate the acceptable pulp even in the upper region of the apparatus.

The open or unpressurized construction of a screening machine described above is suitable particularly as a final stage screener for the various screening residue which collect in a paper mill, including waste paper. A high consistency of rejects is obtainable, particularly with the embodiment in accordance with FIG. 1.

In the radial, sectional view through the drum embodiment, shown in FIG. 4, the leading edges 11 of the vanes are beveled or inclined somewhat rearwardly with respect to the radial direction, in order to avoid spinning of pulp on the vanes.

A wall 19, shown in dashed lines, extends between the upper and lower surfaces 10 and 9 of the vane 4, and is developed such that the volume of the free space 7 between the surfaces 10 and 9 increases continuously from the leading end 11 of the vane. By suitably arranging the wall 19, particularly the angle of the wall with respect to a tangent to the shell of the drum, production of the vacuum and thus the manner of operation of the vanes can be controlled. The wall 19 can be oriented to increase or decrease the volume of the space 7 between the surfaces 10 moving rearwardly from the leading end 11, or vice versa. It can be oriented to increase both the axial height of the space 7 (inherent in wedge surfaces) and the radial width of the space, or alternatively to decrease the radial width of the space, moving rearwardly from the leading end. The wall 19 between the upper and lower surfaces of the vanes 4 also stiffens the vanes so that the wall thickness supporting surfaces 9 and 10 can be reduced. The wall extends from the leading end 11 to the trailing end. Although the wall may simply terminate at the trailing end, it instead turns radially inwardly along the trailing edge of the vane 4 at 19*a*, so that the volume radially inward of the wall 19 is enclosed and does not directly provide a force component to the suspension.

Another possible way to control the vacuum is by adjusting the inclination of the rear edges of the surfaces 9 and 10 with respect to the horizontal. This, of course, depends on the extent of the spiral or helix arrangement of the vanes in the direction for producing a greater or lesser component of conveyance for suspension in the direction toward the rejects outlet.

In the unpressurized screening machine of open construction shown in FIG. 1, the conveying component of the sorting vanes in the direction toward the rejects outlet is important since this also serves for the passage of the good quality pulp.

The factors which influence the conveyance of the fiber suspension, and particularly of the rejects, in the axial direction along the screen slot toward the rejects outlet and the movement of the fiber suspension which leads to good sorting of the good pulp, i.e. of the fibers to be collected, can be adapted to each other. By simple experiment, it is possible to determine the best arrangement in each case for the pulp suspension and type of screening machine on hand.

In the screening machine of the invention, the screen slot 3 can be made relatively narrow so that a relatively low conveying energy is required. A narrow radius annular screen slot 3 is also helpful for assuring that sorting takes place essentially only in the immediate vicinity of the screen 2, while an unnecessarily large screening slot 3, i.e. one with a large radial size can only be disadvantageous.

Although it is not shown in this Figure, substantially vertically extending ledges may be fastened to the inner wall of the screen 2 for producing despecking, in that the vanes which pass closely along the screen (or the ledges) break down the specks present in the fiber suspension.

The vanes 4, particularly in the sorting machines of open unpressurized construction, may be arranged so that upon one revolution of the drum 1, the entire height of the first, lower zone of the screen slot 3, which is provided with sorting vanes 4, is traversed by the vanes. The vanes can, however, also be provided in a denser arrangement on the drum.

Figure 5:
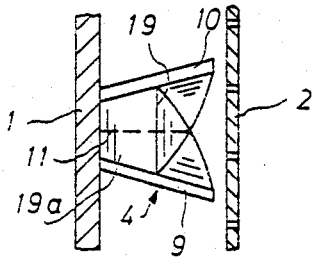
FIG. 5 is a partial axial sectional view through an embodiment of a sorting drum, on a larger scale but also showing features of the embodiment of FIG. 4.

FIG. 5 shows a partial axial section through a drum 1 with vanes 4 having features like those in FIG. 4. In this case, the upper wedge surface 10 and the lower wedge surface 9 of a vane 4 are inclined oppositely to the example of FIG. 1*a* described above. First, as before, the surfaces 9, 10 diverge axially, measured from the vane front end 11, giving the vane a wedge shape. Then, with respect to the horizontal or radial direction, i.e. in a plane perpendicular to the axis, the wedge surfaces are inclined to also diverge as measured axially. In this way, the surfaces produce a conveying component of the fiber suspension that is normally away from the screen 2. Finally, as in FIG. 4, the wall 19 gradually curves radially inwardly moving rearwardly. The radially inwardly turned wall portion 19*a* closes off the space radially inwardly of the wall 19.

With this form of vane, separation of the fiber suspension from the screen is naturally produced to a greater extent than in the previous embodiment. This form of a vane is predominantly used in a closed or pressurized construction of the screening machine. Therefore, pressurized screening machines with sorting of the good pulp is effected from the inside to the outside, i.e. out of the screen slot 3 and accordingly the feeding of the fiber suspension is from the outside into the screen slot 3. The drum 1 is then developed without division into zones, i.e. similar to the embodiment of FIG. 2. The force for feeding the pulp through the sorting machine is supplied in the so-called pressurized screening machines predominantly by the conveyor pump for the fiber suspension.

Figure 6:
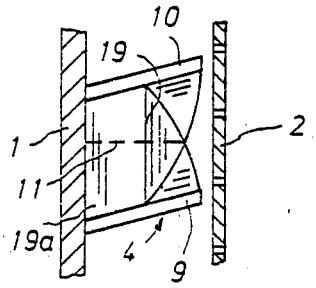
FIG. 6 is a similar sectional view to FIG. 5 showing yet another embodiment of a sorting drum.
Figure 7A:
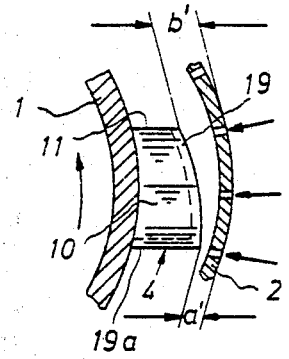
Figure 7B:
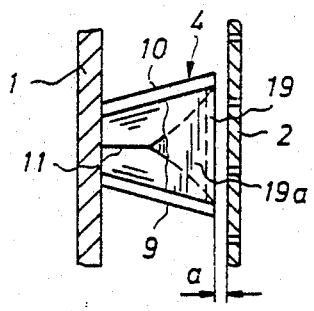
Figure 7C:
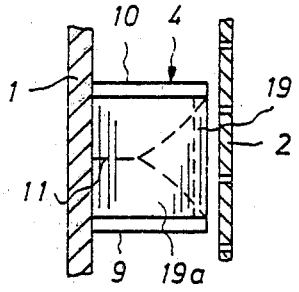

It is finally also possible to combine the two above described inclinations of the surfaces 9 and 10, as viewed along the radial direction, as shown in FIG. 6. Here, the upper surface 10 inclines upwardly or diverges from the horizontal, moving radially outwardly. In this case, eddying is produced to an increased extent at the trailing end of the vanes 4. This loosens the fiber suspension on the screen 2 so that the particles to be sorted are more easily passed through the holes of the screen.

Feeding of the fiber suspension in this embodiment operates as with the embodiment of FIG. 5. This embodiment is used predominantly for the closed, pressurized construction, with the type of drum in accordance with FIG. 2, and also without the division thereof into zones.

The closed construction as illustrated in FIG. 2 closes the housing by a bottom plate. The lower part of the housing includes a socket for the discharge of the rejects, corresponding to the socket 17 provided for the discharge of the accepted suspension.

In FIG. 2, the screening machine provides passage of the rejects from the top to the bottom with respect to the axial component of their movement. The sorting residue, which collects in the screen slot 3 and which would already be relatively strongly concentrated, can be diluted with spray water coming from spray holes 8 in the shell of the drum, and this helps achieve a further sorting out of accepts. The spray water is fed into the interior of the drum 1 via a spray water connecting head 14 which is sealed against the stationary housing of the screening machine, generally at a housing lid, and the hollow drum shaft or a shaft-like connection of the drum, similar to FIGS. 1 to 3.

Figure 3:
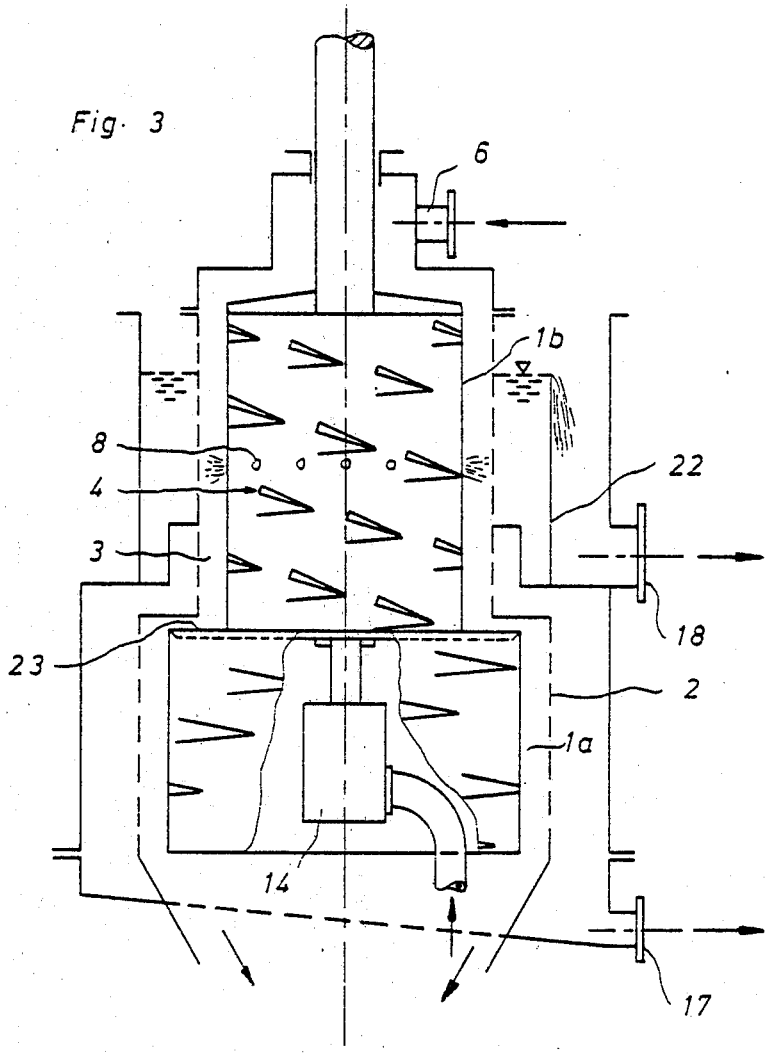

FIG. 3 shows a rotary screening machine of open unpressurized construction. Here the drum 1 and screen slot 3 are also not subdivided into zones. Instead, the drum carries the sorting vanes 4 over its whole surface. Spray-water holes 8 feed spray water via a spray head 14, as in the embodiment of FIG. 1. The inlet for the fiber suspension is in this case located on top at the socket 6 and the discharge of the acceptable quality pulp is at the bottom at the socket 17. Thus, transport of the fiber suspension, and particularly of the rejects, is along the axial direction from the top to the bottom, so that gravity promotes the passage of the heavy rejects. In order to prevent too rapid passage of the fiber suspension, a weir or damming wall 23 is provided, through the lower part 1*a* of the drum being made of a larger diameter than the upper part 1*b* of the drum. An overflow is provided for the upper part 1*b* of the drum, and the purified suspension is dammed up by a weir wall 22. Through a socket 18, the good pulp then emerges after the first or upper zone.

In place of or in addition to this, and as already explained with reference to FIG. 1, the sorting vanes 4 can be shifted with respect to each other so that the upper wedge surfaces thereof impinge to a strong extent on the fiber suspension and thus repeatedly provide the fiber particles with a component of motion in the direction toward the inlet. For this purpose, the angle of inclination of the upper wedge surfaces 10 can be relatively steep, and be steeper than that angle for the lower wedge surfaces 9, because gravity aids the passage of the fiber suspension through the screening machine.

Still another embodiment of a pressure screening machine of closed pressurized construction is possible with, however, the screening of the good quality pulp taking place radially inwarly into the screen slot 3. Here the feeding of the fiber suspension would be radially inward from the outside of the screen basket 2 toward the screen slot.

For the last mentioned embodiment, the vanes 4 are developed in accordance with FIG. *7a* and either FIG. *7b* or *7c*. The wall 19 which extends between the upper wedge surface 10 and the lower wedge surface 9 of vane 4 is arranged so that the free space between the surface of the wall 19 facing toward the screen slot 3 and the screen 2 is continuously reduced from the leading edge 11 to the trailing end of the rotating sorting vane 4. The radial divergence of wall 19 can be seen in FIGS. *7b* and *7c*. The covering rear wall portion 19*a* can also be seen. Pressure is built up in front of the vane, on top and on bottom, and particularly to the side of the vane. Thus, with the selected inward direction of flow of the fibers (see arrows) through the screen basket 2, and with the flow being in a pulsating manner, separation of the solid particles which collect and deposit on the screen basket 2 is effected.

For this construction of the screening machine, the wedge surfaces 9 and 10 of the sorting vanes are radially outwardly inclined in accordance with FIG. 5. This is shown in FIG. *7b*. In this case, the relatively large lateral surface which produces the pressure pulses on the screen basket, i.e., the surface of the side limiting wall 19, is also present. However, an embodiment of vane 4 with noninclined wedge surfaces, as shown in FIG. *7c*, can also be suitably used. The radially converging inclination in accordance with FIG. 1*a* may also possibly be used in this case, but it is not as good as that inclination illustrated in FIG. *7b*.

Since pressure screening machines are used more for fine screening and are generally arranged directly in front of the entrance of the pulp into the paper machine, it is desirable to have the narrowest possible screen slot a at the run-off or trailing end of the sorting vanes in FIG. *7a*, and this slot should amount at most to about 1.5 mm. However, this depends on the size of the screen holes and thus on the degree of fineness of the screening stage, i.e. also on the fiber suspension itself. For best results, the screen slot gradually decreases in radial width from b at the leading edge 11 to the trailing end at a.

The inclination of the limiting wall 19 with respect to a tangent to the circumference of the screen basket will be selected, for instance, at 10°.

The various embodiments of the rotary screening machine produce extremely favorable action, since the development and attachment of a mat of fibers on the screen basket 2 is prevented by the pulsating movement of the pulp across the screen basket. Clogging of the screen holes, starting from the attachment of particles of pulp at one point, namely from the side of the holes facing the direction of rotation, to an ever-increasing extent by the continuous addition of further particles which deposit there, is prevented by the pulsating movement, which repeatedly changes the direction of attack of the particles and the suspension against the screen and its holes. This makes it possible, to an increased extent, for very long fibers of the good pulp to be able to pass through the screen holes. The tendency of these fibers is to align themselves in the circumferential direction, which would substantially prevent passage through the screen holes. The invention avoids this. Due to the low coefficient of resistance of the sorting vanes and in the case of the open unpressurized construction of screening machine, the good conveying action within a relatively narrow screening slot, furthermore only little drive power is required for the conveying of the fiber suspension.

Although the present invention has been described in connection with the preferred embodiments thereof, many variations and modifications will now become apparent to those skilled in the art. It is preferred, therefore, that the present invention be limited not by the specific disclosure herein, but only by the appended claims.

I claim:

1. A rotary screening machine for removing impurities from a pulp suspension of fibers, comprising:

an annular drum rotatable about an axis and having a annular periphery;

a screen basket annularly around the periphery of the drum and radially spaced therefrom for defining an annular screening slot between the drum and the screen basket;

a plurality of vanes supported on the annular periphery of the annular drum; each vane having a leading end and a trailing end with respect to the direction of rotation of the drum around the axis; each vane tapering gradually wider, measured along the axis of the drum, from the leading to the trailing end thereof.

2. The machine of claim 1, wherein the axis is substantially vertical.

3. The machine of claim 2, wherein the screening slot includes an inlet for fiber suspension and an outlet for impurities that are separated from the suspension.

4. The machine of claim 3, wherein the impurities outlet is oriented for discharging impurities tangentially from the screening slot.

5. The machine of claim 1, wherein the vanes are arranged annularly around the drum, and adjacent vanes are staggered in their locations along the drum.

6. The machine of claim 1, wherein the drum and the screen basket are coaxial, and the screening slot has a constant radial width.

7. The machine of claim 1, wherein at an axial location along the length of the drum, the drum having spray holes therethrough for passage of diluting liquid into the screening slot from inside the drum.

8. The machine of claim 1, wherein the drum axis is oriented generally vertically and the drum is divided into at least two zones, including a lower zone, at which the drum is provided with the vanes, and an upper zone, which is free of the vanes; at the upper zone, the drum carries ribs arranged generally in a helical array around the drum, and the ribs cooperate in raising impurities along the axial length of the screening slot;

the inlet for suspension to the screening slot being generally from the bottom of the screening slot and the outlet of impurities from the screening slot being generally toward the top of the screening slot.

9. The machine of claim 1, wherein each vane is wedge shaped and includes an upper wedge surface and a lower wedge surface by which the wedge shape of the vane is defined.

10. The machine of claim 9, wherein each wedge surface has a radially outer edge oriented so that a constant radius slot is defined between the wedge surfaces and the screen basket.

11. The machine of claim 9 wherein the upper surface and the lower surface of each vane meet to form a leading edge at the leading end of the vane, and the leading edge extending, generally radially from the drum.

12. The machine of claim 9, wherein the annular periphery of the drum is divided into at least two zones, one zone carrying the vanes and the other zone being free of vanes and thereby having a smoother surface; the smoother surface zone being axially nearer to the exit of impurities from the screening slot.

13. The machine of claim 12, further comprising means for feeding suspension into the screening slot; wherein the impurities exit from the screening slot generally toward one axial end of the screening slot;

the impurities outlet being oriented for discharging impurities tangentially from the screen slot.

14. The machine of claim 13, wherein the impurities outlet lies above the screening slot.

15. The machine of claim 9, wherein at an axial location along the length of the drum, the drum having spray holes therethrough for passage of diluting liquid into the screening slot from inside the drum.

16. The machine of claim 15, wherein the screen basket includes fiber sorting openings therethrough, but the openings are not provided at the axial location generally opposed to the spray holes.

17. The machine of claim 9, wherein the drum axis is oriented generally vertically and the drum is divided into at least two zones, including a lower zone, at which the drum is provided with the vanes, and an upper zone, which is free of the vanes; at the upper zone, the drum carries ribs arranged generally in a helical array around the drum, and the ribs cooperate in raising impurities along the axial length of the screening slot;

an inlet for suspension to the screening slot being generally from the bottom of the screening slot and an outlet of impurities from the screening slot being generally toward the top of the screening slot.

18. The machine of claim 17, wherein the drum includes a third zone above the upper zone, and in the third zone, the annular periphery of the drum being essentially smooth.

19. The machine of claim 9, wherein the screening slot includes an inlet for fiber suspension and an outlet for impurities that are separated from the suspension.

20. The machine of claim 19, wherein the impurities outlet is oriented for discharging impurities tangentially from the screening slot.

21. The machine of claim 20, wherein the impurities outlet lies above the screening slot.

22. The machine of claim 9, wherein each vane is shaped so that a space is defined between the upper and the lower wedge surfaces thereof.

23. The machine of claim 22, further comprising a wall located in the space, facing radially outwardly toward the screen basket, extending generally rearwardly from the leading end of the vane, extending between the upper and lower wedge surfaces of the vane and being oriented with respect to the screen basket for providing an additional pressure pulse on the suspension in the screening slot as the vanes rotate.

24. The machine of claim 23, wherein the wall is so shaped that, as the wedge surfaces taper wider toward the vane rear end, which enlarges the space, the wall is also so oriented that the volume of the space, as defined between the upper and lower wedge surfaces and the wall and the screen basket, increases from the leading end to the trailing end of the vane.

25. The machine of claim 24, wherein the orientation of the wall deviates from the circumferential direction around the drum.

26. The machine of claim 25, wherein the wall is so oriented that the radial width between the wall and the screen basket and the axial height between the wedge surfaces of the space, both increase from the leading to the trailing end of the vane.

27. The machine of claim 26, wherein each wedge surface has a radially outer edge oriented so that a constant radius slot is defined between the wedge surfaces and the screen basket.

28. The machine of claim 23, wherein the wall is so oriented that it is radially further from the screen basket at the leading end of the vane and is relatively radially closer to the screen basket toward the trailing end of the vane.

29. The machine of claim 28, further comprising means pressurizing the screening machine for increasing the pressure in the screening slot above the pressure outside the screen basket.

30. The machine of claim 22, wherein the drum axis is oriented generally vertically and the drum is divided into at least two zones, including a lower zone, at which the drum is provided with the vanes, and an upper zone, which is free of the vanes; at the upper zone, the drum carries ribs arranged generally in a helical array around the drum, and the ribs cooperate in raising impurities along the axial length of the screening slot;

the inlet for suspension to the screening slot being generally from the bottom of the screening slot and the outlet of impurities from the screening slot being generally toward the top of the screening slot.

31. The machine of claim 30, wherein the drum includes a third zone above the upper zone, and in the third zone, the annular periphery of the drum being essentially smooth.

32. The machine of claims 1 or 22, wherein the radial dimension of the vanes is substantially constant.

33. The machine of claims 1 or 22, wherein the radial dimension of the vanes is greatest at the leading end thereof.

34. The machine of claim 1 or claim 22 wherein the vanes are supported directly on the annular periphery of the annular drum.

35. The machine of claim 22, wherein each vane comprises two walls, the walls extending generally radially from the drum, the space being defined between the walls, the upper surface and said lower surface each being defined by one of the walls, the walls meeting to define the leading edge, and the leading edge extending generally radially from said drum.

36. The machine of claim 9, wherein at least one of the upper and lower wedge surfaces is inclined from a plane that is perpendicular to the axis, when that wedge surface is viewed along a radius of the drum, for producing a fiber suspension conveyence component through the screening slot.

37. The machine of claim 36, wherein at least one wedge surface of the vane is inclined from a plane that is perpendicular to the axis for providing a component of movement of the fiber suspension that is radially outward toward the screen basket.

38. The machine of claim 37, wherein the screening slot is unpressurized; means for feeding fiber suspension into the screening slot; the feeding means feeding suspension from outside the screen basket to pass into the screeing slot through the screen basket.

39. The machine of claim 36, further comprising means for feeding suspension into the screening slot; an impurities exit from the screening slot generally toward one axial end of the screening slot;

a second plurality of vanes nearer to the impurities outlet generally than the first mentioned plurality of vanes; the wedge surface that faces away from the impurities outlet of each of the second plurality of vanes being inclined with respect to a plane that is perpendicular to the axis, so as to create a smaller component of conveyance of suspension through the screen slot away from the impurities outlet than the corresponding wedge surface of each of the first mentioned plurality of vanes.

40. The machine of claim 39, wherein the screening slot is unpressurized, and the impurities outlet is nearer the top of the screening slot with the axis being substantially vertical.

41. The machine of claim 40, wherein the annular periphery of the drum is divided into at least two zones, one zone carrying the vanes and the other zone being free of vanes and thereby having a smoother surface; the smoother surface zone being axially nearer to the exit of impurities from the screening slot.

42. The machine of claim 39, wherein the impurities outlet is oriented for discharging impurities tangentially from the screen slot.

43. The machine of claim 36, further comprising means for feeding suspension into the screening slot; wherein the impurities exit from the screening slot generally toward one axial end of the screening slot;

a second plurality of vanes nearer to the impurities outlet generally than the first mentioned plurality of vanes; the wedge surface facing away from the impurities outlet of each of the second plurality of vanes being of shorter radial length toward the screen basket than the other wedge surface of that vane, leaving a larger radial space between the shorter radial length wedge surface and the screen basket than for the other wedge surface of that vane.

44. The machine of claim 12 or 43, wherein a group of the vanes in the zone of the drum carrying vanes are the vanes adjacent the smoother surface zone, and are arrayed approximately once around the circumference of the drum generally in a helix.

45. The machine of claim 44, wherein the screening slot is unpressurized, and the impurities outlet is nearer the top of the screening slot with the axis being substantially vertical.

46. The machine of claim 43, wherein the screening slot is unpressurized, and the impurities outlet is nearer the top of the screening slot with the axis being substantially vertical.

47. The machine of claim 36, wherein each vane is shaped so that a space is defined between the upper and lower wedge surfaces thereof.

48. The machine of claim 41 wherein the space is open in the outwardly radial direction from the drum.

49. The machine of claim 47, further comprising a wall located in the space, facing radially outwardly toward the screen baskets extending generally rearwardly from the leading end of the vane, extending between the upper and lower wedge surfaces of the vane and being oriented with respect to the screen basket for providing an additional pressure pulse on the suspension in the screening slot as the vanes rotate.

50. The machine of claim 49, wherein the screening slot has an outlet for impurities that are separated out of the fiber suspension during rotation of the vanes through the screening slot; means for feeding fiber suspension into the screening slot;

the wedge surfaces being so inclined with respect to a plane perpendicular to the axis as to produce components of conveyance for the fiber suspension in a direction along the axis and toward the impurities outlet from the screening slot.

51. The machine of claim 50, wherein the wedge surfaces are also so inclined that they also produce components of conveyance of the fiber suspension in the opposite direction away from the impurities outlet.

52. The machine of claim 47, wherein at least one wedge surface of the vane is inclined from a plane that is perpendicular to the axis for providing a component of movement of the fiber suspension that is radially outward toward the screen basket.

53. The machine of claim 52, wherein the screening slot is unpressurized; means for feeding fiber suspension into the screening slot; the feeding means feeding suspension from outside the screen basket to pass into the screening slot through the screen basket.

54. The machine of claim 36, wherein the screening slot has an outlet for impurities that are separated out of the fiber suspension during rotation of the vanes through the screening slot; means for feeding fiber suspension into the screening slot;

the wedge surfaces being so inclined with respect to a plane perpendicular to the axis as to produce components of conveyance for the fiber suspension in a direction along the axis and toward the impurities outlet from the screening slot.

55. The machine of claim 54, wherein at least one wedge surface of the vane is inclined from a plane that is perpendicular to the axis for providing a component of movement of the fiber suspension that is radially outward toward the screen basket.

56. The machine of claim 55, wherein the screening slot is unpressurized; means for feeding fiber suspension into the screening slot; the feeding means feeding suspension from outside the screen basket to pass into the screening slot through the screen basket.

57. The machine of claim 54, wherein the impurities exit from the screening slot in generally toward one axial end of the screening slot;

a second plurality of vanes nearer to the impurities outlet generally than the first mentioned plurality of vanes; the wedge surface that faces away from the impurities outlet of each of the second plurality of vanes being inclined with respect to a plane that is perpendicular to the axis so as to create a smaller component of conveyance of suspension through the screen slot away from the impurities outlet than the corresponding wedge surface of each of the first mentioned plurality of vanes.

58. The machine of claim 54, wherein the impurities outlet is oriented for discharging impurities tangentially from the screen slot.

59. The machine of claim 58, wherein the impurities outlet lies generally above the screening slot.

60. The machine of claim 54, wherein the screening slot is unpressurized as compared with the pressure outside the screen basket.

61. The machine of claim 60, wherein the wedge surfaces are also so inclined that they also produce components of conveyance of the fiber suspension in the opposite direction away from the impurities outlet.

62. The machine of claim 61, wherein the inclined wedge surface of the vane is inclined from a plane that is perpendicular to the axis for providing a component of movement of the fiber suspension that is radially outward toward the screen basket.

* * * * *